United States Patent [19]

Powell et al.

[11] 4,303,226

[45] Dec. 1, 1981

[54] SWIMMING POOL FENCE

[75] Inventors: George G. Powell; Reece J. Powell, both of Broadford, Australia

[73] Assignee: Sinclair & Powell Proprietary Limited, Victoria, Australia

[21] Appl. No.: 98,615

[22] Filed: Nov. 29, 1979

[30] Foreign Application Priority Data

Dec. 13, 1978 [AU] Australia ..... PD7095

[51] Int. Cl.[3] ..... E04H 17/18

[52] U.S. Cl. ..... 256/25; 4/496

[58] Field of Search ..... 256/25, 24, 1, 26; 4/172.19, 172, 506, 494

[56] References Cited

U.S. PATENT DOCUMENTS

| | | | |
|---|---|---|---|
| 3,458,875 | 8/1969 | Michalke et al. | 4/172.19 |
| 3,604,685 | 9/1971 | Pokryfki | 256/26 X |
| 3,638,245 | 2/1972 | Birkemeier | 4/172.19 |
| 3,648,303 | 3/1972 | Stewart et al. | 4/172.19 |
| 3,815,877 | 6/1974 | Turner | 256/25 X |
| 3,994,479 | 11/1976 | Johannesson | 256/24 |

*Primary Examiner*—Andrew V. Kundrat

*Attorney, Agent, or Firm*—Burns, Doane, Swecker & Mathis

[57] ABSTRACT

The present invention relates to a pool fence construction comprising at least one fence section having attachment means associated or integral with each end thereof, said fence section further adapted to be connected directly or indirectly to an upper periphery of a pool, wherein said upper periphery is above the ground.

20 Claims, 11 Drawing Figures

SWIMMING POOL FENCE

The present invention relates to a pool fence construction adapted for use with above ground swimming pools.

In recent years sales of swimming pools has increased dramatically, this trend having been apparently catalysed, in particular, by the development of high quality synthetic pools of the above ground type. Such pools may be erected easily by an unskilled person on at relatively low cost.

Irrespective of the type of pool, a cover or adequate security fencing is required. In particular the fencing must prevent unauthorized admission to the pool. Tragically, unattended pools with no or inadequate fencing have been the sites of numerous drownings in recent years and some municipalities are now enforcing stringent regulations on private pools. In this respect there has been proposed to use fencing surrounding pools. Such fencing requires the erection of the fence in the ground surrounding the pool. Apart from the obvious high cost thereof, such fencing entails wasteful utilization of space and restricts the positioning of above ground pools. There has been little throught given to security fencing which is specifically adapted for attachment to above ground pools. There is, therefore, in view of the ever-increasing popularity of above ground pools, a pressing need for such type security fencing. Further, the above ground pool, like the in ground type, needs to be covered, or capable of being covered, and thus any consideration of fencing in association with the pool must permit this.

It is therefore an object of the present invention to provide fencing means which are strong, inexpensive, easily erected in association with pools which have an upper periphery above the ground, and which does not entail waste of available ground space.

With this object in mind there is provided a pool fence construction comprising at least one fence section having attachment means associated or integral with each end thereof, said fence section further adapted to be connected directly or indirectly to an upper periphery of a pool, wherein said upper periphery is above the ground.

In one version of the invention the fencing section substantially surrounds the pool, following the upper periphery thereof. Obviously this construction is most useful for smaller sizes of pools where the single length of fence section will be manageable. In contrast to the unitary fence in another version of the invention two or more fence sections are present, the attachment means mentioned above facilitating the connection of adjacent sections when placed in end to end relationship.

In a preferred embodiment the attachment means comprise, at one end of a fence section, at least one eyelet, whilst at the other end comprise at least one substantially vertical projection, so that the projection(s) of one end of a first fence section releasably engage the eyelet(s) of one end of a second fence section.

A gate or opening may be provided in the fence construction and in this respect a gate may comprise two laterally spaced upright members defining the gate opening therebetween. Each of the two laterally spaced upright members being adapted to be connected to at least the upper periphery of the pool. In a more preferred embodiment these members may extend to the bottom periphery of the pool and be directly or indirectly connected thereto, which construction considerably strengthens these gate uprights.

For the attachment of the pool fence section to the upper periphery of the pool, two alternate methods may be used. The first alternative is to provide the upper periphery with at least one aperture, perferably of a keyhole shape, same being so positioned to facilitate connection of the fence therein. Alternatively the upper periphery of the pool is provided with at least one mounting bracket. Typically this mounting bracket comprises an affixing portion to facilitate attachment to a portion of the pool, and a receiving portion to which the fence section is connected. One possible shape of the receiving portion is a general U shape which also has an aligned set of apertures to permit the substantially vertical projection of one of the fence sections as discussed above, to pass therethrough. For ease of installation it is also convenient if the mounting bracket is fabricated from material which exhibits some resilience as the fence section would not have projections which would be perfectly aligned with the aforementioned apertures. In yet another preferred configuration of the bracket one of the apertures is provided with a keyway whilst the substantially vertical projection is provided with a horizontal protrusion or tab. With such it is possible to install the fence section on the upper periphery of the pool, the substantially vertical projection located at one end of the fence section being inserted through the set of apertures and eyelets whereafter the fence section is pivoted thereabout which rotates the protrusion away from the keyway effectively preventing upward movement whilst simultaneously moving the other end of the fence section into its operable position above the periphery of the pool.

Referring now specifically to the construction of above ground pools, the same falls into two types, one incorporating the use of struts which support the pool wall, and those which need no bracing, being free-standing. The invention is adaptable for use with either type. When struts are present these form convenient sites for attachment of the mounting bracket, however, when not present the receiving means can be suitably designed for adequate connection to the pool edge.

Further, when in place the fencing of the present invention may be of a shape which facilitates the operation of placing or removing a pool cover. Similarly by using an open grill type fencing construction it is equally easy to carry out normal pool cleaning maintenance. For example the pool filter and pipes can penetrate through the fence. In the same vein replacement of the pool liner which is occasionally necessary may be easily carried out with the aforementioned open construction.

In a further preferred embodiment of the present invention one of the fence sections, not being one immediately adjacent to a gate opening if one exists, is provided with eyelets at each end thereof so that in operation one end is affixed by connection with an adjacent fence section whilst the other end when located above the upper periphery has one or more eyelets aligned with one or more eyelets of the next succeeding fence section thereby permitting connection thereto by installation of a suitable elongated member through all of these aligned eyelets and preferably into the mounting means. With this construction it is possible to have an excess point at any desired position around the pool which allows easy cleaning, etc.

As an alternative construction to that described immediately above one of the fence sections, not being one immediately adjacent a gate opening if present, is provided at one end thereof with at least one shortened substantially vertical projection whilst at least one eyelet is provided at the other end thereof, so that in operation said other end is affixed by connection with an adjacent fence section whilst the said end when located above the upper periphery is adapted to be upwardly deformed thus permitting said shortened substantially vertical projection to engage an eyelet of the next succeeding fence section thereby permitting connection thereto.

Referring specifically to the provisions of a gate, for safety reasons it is preferable to design such to be of the automatic closing and self-latching type. Provision is also made on the gate upright for attachment of a padlock or other locking mechanism. However it is convenient to incorporate a locking means to hold the gate in an open position to facilitate cleaning.

The invention will now be illustrated with reference to the accompanying drawings in which FIG. 1 is a perspective view of a pool with an assembly of sections according to one preferred aspect of the present invention.

Figure 1:
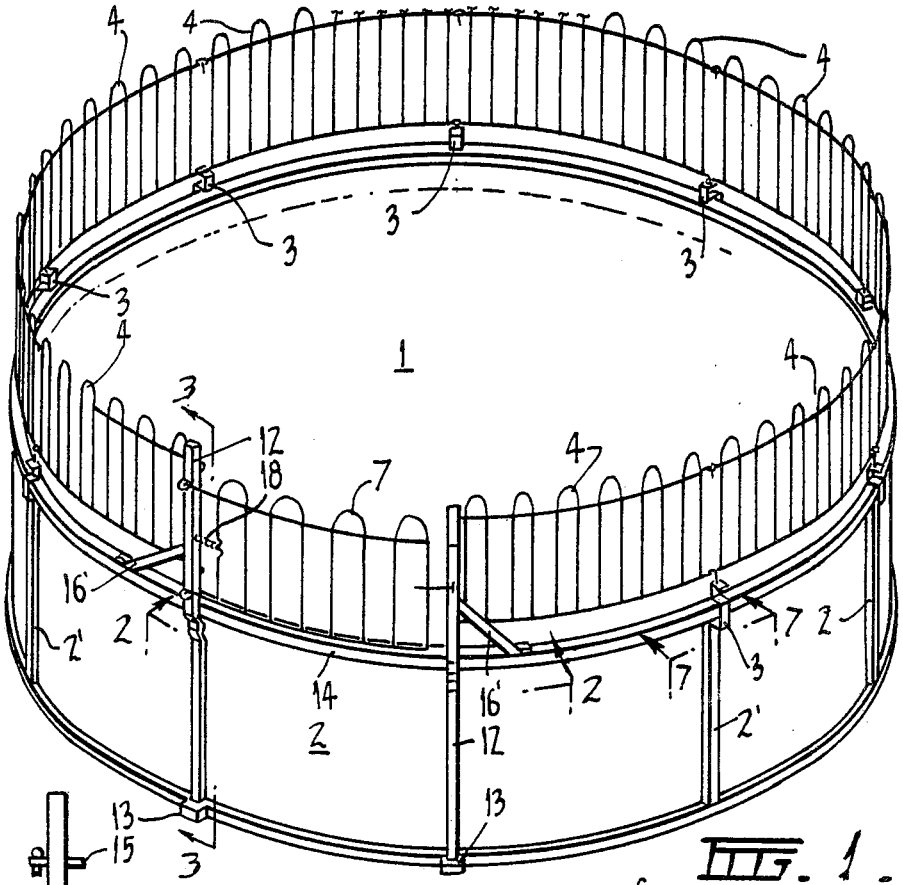
Figure 5:
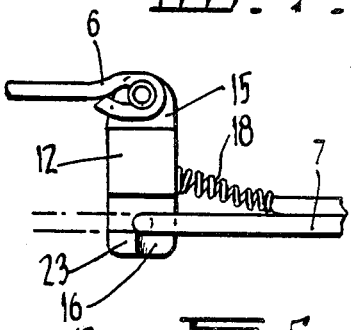
FIG. 5 is a plan view of the upper area of one of the uprights for the gate arrangement of FIG. 2.
Figure 6:
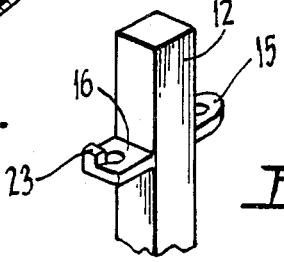
FIG. 6 is a perspective view of the upper area of one of the uprights.
Figure 2:
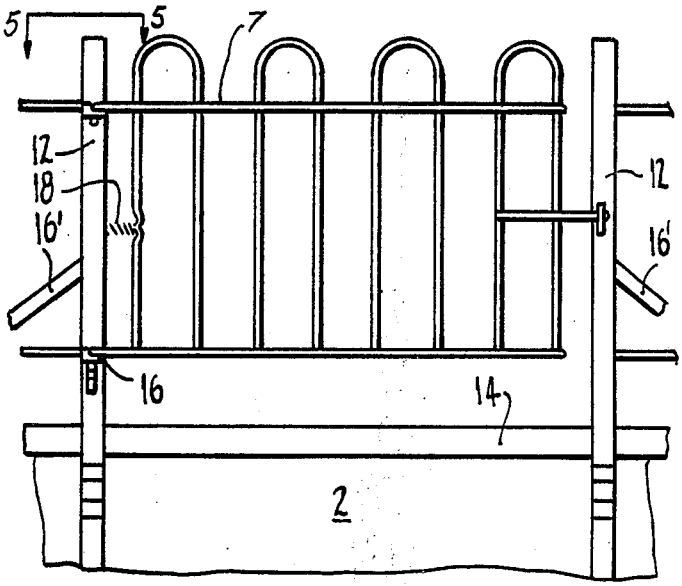
FIG. 2 is a front view of the gate arrangement.
Figure 7:
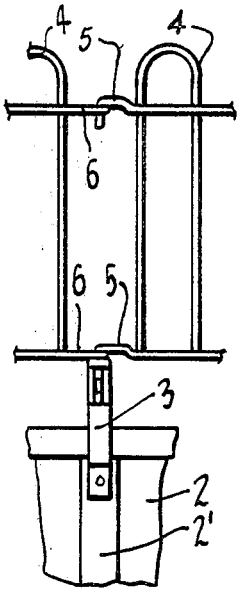
FIG. 7 is a segment view of a section connecting means of the present invention.
Figure 9:
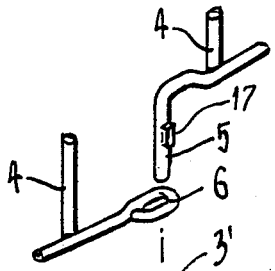
FIG. 9 is a view of the upper periphery of the pool with integral connecting means.
Figure 9:
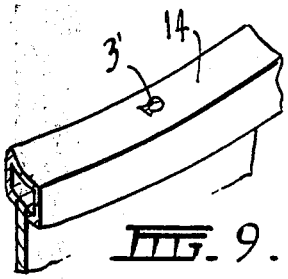
Figure 8:
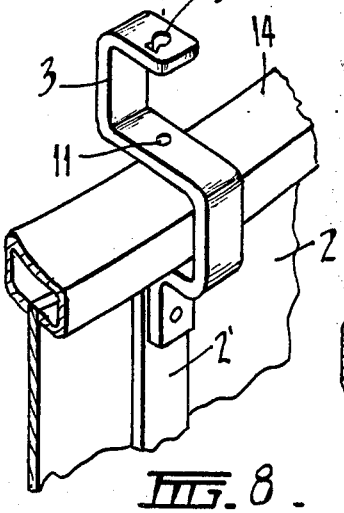
FIG. 8 shows an assembly breakdown of the connecting means.

Reference to FIG. 1 reveals an above ground pool having a pool wall 2 with supports 2'. The fencing shown encircles the pool 1 and is coextensive therewith. Gate 7 is provided which is outwardly rotatable about a gate post 12 towards the outside of the fence. Whilst assembly of the pool 1 is well known, in practice support posts 2' may have considerable variance in their distance from adjacent supports 2'. In view of this variation it is preferable to provide section receiving means of resilient nature to allow for this discrepancy. To each support 2' there is attached a section receiving member 3 as depicted in FIGS. 7 and 8. The lower part of receiving means 3 is typically riveted or screwed to support 2' and the upper part of receiving means 3 forms a U shape with aligning holes 11. In this respect the upper aperture 3' is a keyway. An alternative arrangement to the use of this section receiving means is shown in FIG. 9 wherein the keyway 3' is formed integrally in the upper periphery 14 of the pool. Thus sections 4 being provided at one end with hooks 5 and at the other end with apertures 6, interengage and the lower hook 5 of the section 4 penetrates through both apertures and then the section carrying hook 5 is rotated so its other end is in position, i.e. over the periphery of the pool. Accordingly as protrusion 17 is no longer in alignment with keyway 3' no disengagement can occur. This sequence is carried out around the pool until one section width remains and reference to FIG. 6 shows post 12 being provided with a rearwardly projecting aperture 15 to which the remaining free end of that section 4 may be bolted. A similar connection occurs adjacent to the lower extremity of the section 4. Posts 12 are fixed to a pair of supports 2' and extend to the bottom of the pool. As this opening is to house the gate 7 the posts 12 are additionally supported by braces 16' which span between posts 12 and the upper periphery of the pool. As mentioned gate 7 is provided and FIGS. 2, 5 and 6 more clearly illustrate same. Gate 7 has a pair of spaced hooks at one end, the lower end of which is provided with a tab. Post 12 is provided in an upper area thereof with apertured projection 16 whilst in an area below that with a keyhole projection (not shown). As will be appreciated from FIGS. 2, 5 and 6, the gate 7 is attached by holding same at right angles to the fence and inserting said hooks through the apertures provided on the post. As apertured projection 16 is provided with an upstanding section 23 same will not permit the gate to open more than 90° to the fence. In this respect this upstanding section permits the gate 7 to be maintained in the open position in that to effect the maintenance of the gate 7 in the open position, it is rotated until the rail portion of gate 7 contacts projection 23. The gate is then lifted so that the rail portion is passed over the upper extremity of projection 23 and the gate is therefore held open. To close the gate, the gate is elevated to clear projection 23 and rotated towards the right hand post until clear of such projection and allowed to drop thus permitting spring 18 to effect a closing movement of the gate 7. In this respect spring 18 is positioned such that it experiences increasing tension as the gate 7 is opened outwardly.

Figure 11:
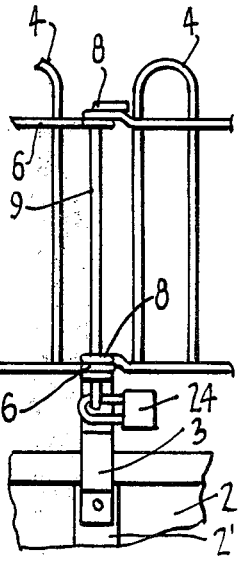
FIG. 11 is a segment view of an alternate version of the access position of FIG. 10.
Figure 10:
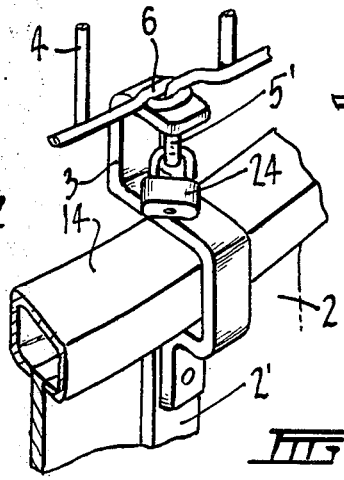
FIG. 10 is a perspective view of an additional access position in the pool fence.

FIG. 10 shows how a modification to one of the connections of adjacent sections 4 can permit two of these sections to be rotated outwardly. This is useful in a large pool when more than one access section is necessary. In this arrangement lower hook 5' of one of the sections is shortened and is provided with an aperture to receive a padlock 24. In view of the shortening of the hook 5' same can be deflected upwardly and thus spring into engagement with an associated eyelet 6. As an alternative to this modification, FIG. 11 depicts instead of one of the meeting sections having hooks 5' as mentioned, there is provided eyelets 8 and affixing is by means of a separate member 9 which has an end configuration similar to the normal hook 5.

Sections 4 may take on any configuration, however, as shown in the drawings they should be such to reduce unauthorized entry to the pool, and, further, by designing the lower extremity thereof to be distant from the periphery of the pool, easy cleaning and maintenance of the pool 1 is achieved.

Figure 3:
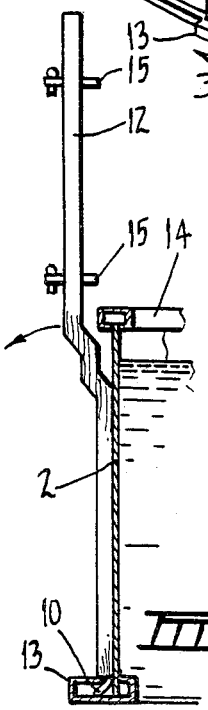
FIG. 3 is a cross-sectional view of one of the gate uprights.
Figure 4:
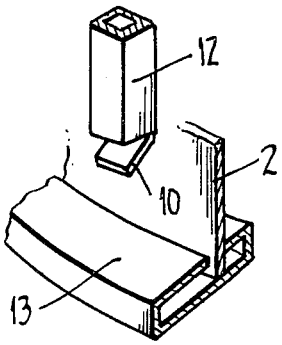
FIG. 4 is an assembly view of the connection between the upright and lower periphery of the pool.

Reference to FIGS. 3 and 4 shows that the posts 12 have an angled foot 10 which engages the lower pool periphery 13 by rotation of upright 12 into the vertical position. This arrangement considerably strengthens the post structure together with connecting braces 16' aforementioned.

As previously mentioned any of sections 4 may be adapted for rotatable movement about one end thereof so that the pool can be more accessible.

With the pool fence hereinbefore described it is possible to quickly assemble such on an above ground pool, and by reason of the simplicity in design make it capable of economical manufacture. Such is therefore a viable alternative to normal pool covers and fences generally used as security devices.

We claim:

1. A pool fence to be arranged atop a swimming pool of the type which includes a water-retaining wall, and a plurality of upright support posts disposed therearound, said fence comprising:

at least one fence section;

attachment means at each end of said at least one fence section for interconnecting ends of said at least one fence section;

mounting means including a receiving portion to which said at least one fence section is connectable; and connecting means for connecting said mounting means to said support posts;

said mounting means being resilient to enable said receiving portion to be displaced to compensate for nonuniform spacing of the pool support posts with respect to the length of said at least one fence section.

2. A pool fence construction according to claim 1 wherein said at least one fence section substantially surrounds said pool and follows the upper periphery thereof.

3. A pool fence construction according to claim 2 wherein said attachment means comprise: at a first end of a fence section, at least one eyelet, and at a second end of said fence section, at least one substantially vertical projection, so that said at least one projection of said first end of said fence section releasably engages said at least one eyelet of said second end of said fence section.

4. A pool fence construction according to claim 1 wherein two or more fence sections are present, said attachment means interconnecting adjacent fence sections.

5. A pool fence construction according to claim 4 wherein said attachment means comprise: at a first end of a fence section, at least one eyelet, and at a second end of said fence section, at least one substantially vertical projection, so that said at least one projection of said first end of a first fence section releasably engages said at least one eyelet of a second end of a second fence section.

6. A pool fence construction according to claim 1 wherein a gate or opening is provided.

7. A pool fence construction according to claim 6 wherein said gate comprises two laterally spaced upright members defining a gate opening therebetween, each of said two laterally spaced upright members being adapted to be connected to at least the upper periphery of the pool.

8. A pool fence construction according to claim 7 wherein the ends of the fence section(s) immediately adjacent each upright member are attached thereto.

9. A pool fence construction according to claim 1 wherein said receiving portion comprises a generally U shaped section with an aligned opposite set of apertures.

10. A pool fence construction according to claim 9 wherein at least one of said set of apertures has a keyway and said substantially vertical projection is provided with a horizontal protrusion such that to install the fence section on the upper periphery of the pool, the substantially vertical projection, located at one end of the fence section, is inserted through the set of apertures whereafter the fence section is pivoted thereabout which rotates the protrusion away from the keyway effectively preventing upward movement whilst simultaneously moving the other end of said fence section into its operable position above the periphery of the pool.

11. A pool fence construction according to claim 4 wherein one of said fence sections, not being one immediately adjacent a gate opening if present, is provided at one end thereof with at least one shortened substantially vertical projection whilst at least one eyelet is provided at the other end thereof, so that in operation said other end is affixed by connection with an adjacent fence section whilst the said end when located above the upper periphery is adapted to be upwardly deformed thus permitting said shortened substantially vertical projection to engage an eyelet of the next succeeding fence section thereby permitting connection thereto.

12. A pool fence construction according to claim 4 wherein one of said fence sections, not being one immediately adjacent a gate opening if present, is provided with eyelets at each end thereof, so that in operation one end is affixed by connection with an adjacent fence section whilst the other end when located above the upper periphery has one or more eyelets which align with one or more eyelets of the next succeeding fence section thereby permitting connection thereto by installation of a suitable elongated member through all of these aligned eyelets.

13. A pool fence construction according to claim 7 wherein said upright members extend to the bottom periphery of said pool and connect therewith.

14. A pool fence construction according to claim 6 wherein said gate is adapted to be locked into a fully open position.

15. A pool fence construction according to claim 7 wherein said gate is adapted to automatically close when no opening moment is applied or maintained.

16. A pool fence for a swimming pool having a water-retaining wall with an upper periphery, said fence comprising:

at least one fence section;

attachment means at each end of said at least one fence section for interconnecting ends of said at least one fence section;

connection means on said at least one fence section for connecting said at least one fence section to said swimming pool; and at least one aperture provided in said upper periphery of said swimming pool for receiving said connection means to connect said at least one fence section to said swimming pool, said connection means being engageable with said at least one aperture and rotatable therein.

17. The pool fence of claim 16 wherein in a first orientation of said connection means said connection means permit said at least one fence section to be disconnected from said upper periphery and in a second orientation of said connection means said connection means prevent said at least one fence section from being disconnected from said upper periphery.

18. The pool fence of claim 16 wherein said at least one aperture is in the shape of a keyhole.

19. The pool fence of claims 1 or 16 wherein the attachment means are integral with said at least one fence section.

20. The pool fence of claims 1 or 16 wherein the attachment means are removably connectible with said at least one fence section.

* * * * *